US007874322B2

(12) United States Patent
Ueda

(10) Patent No.: US 7,874,322 B2
(45) Date of Patent: Jan. 25, 2011

(54) INDUSTRIAL TWO-LAYER FABRIC

(75) Inventor: Ikuo Ueda, Fuji (JP)

(73) Assignee: Nippon Filcon Co., Ltd., Tokyo (JP)

( * ) Notice: Subject to any disclaimer, the term of this patent is extended or adjusted under 35 U.S.C. 154(b) by 0 days.

(21) Appl. No.: 12/733,158

(22) PCT Filed: Oct. 6, 2008

(86) PCT No.: PCT/JP2008/068176

§ 371 (c)(1),
(2), (4) Date: Feb. 8, 2010

(87) PCT Pub. No.: WO2009/044914

PCT Pub. Date: Apr. 9, 2009

(65) Prior Publication Data

US 2010/0221499 A1 Sep. 2, 2010

(30) Foreign Application Priority Data

Oct. 5, 2007 (JP) ..... 2007-261690
Oct. 5, 2007 (JP) ..... 2007-261692

(51) Int. Cl.
*D21F 7/08* (2006.01)
*D03D 3/04* (2006.01)
*D03D 25/00* (2006.01)

(52) U.S. Cl. ..... 139/383 A; 139/383 R; 162/358.2

(58) Field of Classification Search ..... None
See application file for complete search history.

(56) References Cited

U.S. PATENT DOCUMENTS 3,603,354 A * 9/1971 Lee et al. ..... 139/383 A (Continued)

FOREIGN PATENT DOCUMENTS

JP 2006-144145 6/2006

(Continued)

*Primary Examiner*—Bobby H Muromoto, Jr.
(74) *Attorney, Agent, or Firm*—Flynn, Thiel, Boutell &Tanis, P.C.

(57) ABSTRACT

The object of the present invention is to provide an industrial two-layer fabric which exhibits good hydration property and good air permeability by forming a longitudinal groove on its upper surface side through a weave design without decreasing the number of warps, while at the same time exhibits good fiber supportability, good surface smoothness and high rigidity.

The present invention provides an industrial two-layer fabric constituted by at least one upper surface side warp to be woven with at least one upper surface side weft, at least one lower surface side warp to be woven with at least one lower surface side weft, and at least one warp binding yarn to be woven with the at least one upper surface side weft and the at least one lower surface side weft comprising at least one pair of upper and lower warps in which said upper and lower surface side warps are located to be upper and lower, respectively, and at least one pair of warp binding yarns in which at least one yarn constitutes the warp binding yarn, characterized in that all knuckles emerging on the upper surface side formed by the yarns of said pair of warp binding yarns are aligned with knuckles on the upper surface side formed by the upper surface side warp adjacent to said pair of warp binding warps to form a hydrating groove.

9 Claims, 10 Drawing Sheets

U.S. PATENT DOCUMENTS

| | | | | |
|---|---|---|---|---|
| 4,813,156 | A * | 3/1989 | Ashworth et al. | 34/116 |
| 4,943,476 | A * | 7/1990 | Sokaris | 442/187 |
| 5,343,896 | A * | 9/1994 | Schroder et al. | 139/383 A |
| 5,421,375 | A * | 6/1995 | Praetzel | 139/383 A |
| 5,437,315 | A * | 8/1995 | Ward | 139/383 A |
| 5,449,026 | A * | 9/1995 | Lee | 139/383 A |
| 5,454,405 | A * | 10/1995 | Hawes | 139/383 A |
| 5,482,567 | A * | 1/1996 | Barreto | 139/383 A |
| 5,544,678 | A * | 8/1996 | Barrett | 139/383 A |
| 5,713,397 | A * | 2/1998 | Quigley | 139/383 A |
| 6,179,013 | B1 * | 1/2001 | Gulya | 139/383 A |
| 6,207,598 | B1 * | 3/2001 | Lee et al. | 442/206 |
| 6,585,006 | B1 * | 7/2003 | Wilson et al. | 139/383 A |
| 6,860,969 | B2 * | 3/2005 | Troughton | 162/348 |
| 7,059,357 | B2 * | 6/2006 | Ward | 139/348 |
| 7,219,701 | B2 * | 5/2007 | Ward | 139/383 A |
| 2006/0102244 | A1 | 5/2006 | Ueda et al. | |
| 2006/0260708 | A1 | 11/2006 | Ueda et al. | |
| 2006/0278295 | A1 | 12/2006 | Ueda et al. | |
| 2007/0095147 | A1 | 5/2007 | Kikuiri et al. | |

FOREIGN PATENT DOCUMENTS

| | | |
|---|---|---|
| JP | 2006-322109 | 11/2006 |
| JP | 2006-328585 | 12/2006 |
| JP | 2007-119965 | 5/2007 |

* cited by examiner

INDUSTRIAL TWO-LAYER FABRIC

TECHNICAL FIELD OF THE INVENTION

The present invention relates to an industrial two-layer fabric which forms a longitudinal groove on its upper surface side by a combination of a design, and, in particular, relates to the industrial two-layer fabric which exhibits good hydration property and good air permeability by forming the longitudinal groove on its upper surface side and improves fiber supportability and surface smoothness by increasing shooting counts of wefts due to the low density of the upper surface side warp, while causes no influence on the rigidity due to no decrease of the number of warps.

BACKGROUND ART

Fabrics obtained by weaving warps and wefts have conventionally been used widely as an industrial fabric. They are, for example, sued in various fields including papermaking wires, conveyor belts and filter cloths and are required to have fabric properties suited for the intended use or using environment. Of such fabrics, a papermaking wire used in a papermaking step for removing water from raw materials by making use of the network of the fabric must satisfy a severe demand. There is therefore a demand for the development of fabrics which do not transfer a wire mark of the fabric and therefore have excellent surface property, have enough rigidity and therefore are usable desirably even under severe environments, or are capable of maintaining conditions necessary for making good paper for a prolonged period of time. In addition, fiber supporting property, improvement in a paper making yield, good water drainage property property, wear resistance, dimensional stability and running stability are demanded. In recent years, owing to the speed-up of a paper making machine, requirements for papermaking wires become severe further.

Since most of the demands for industrial fabrics and solutions thereof can be understood if papermaking fabrics on which the most severe demand is imposed among industrial fabrics will be described, the present invention will hereinafter be described by used of the papermaking fabric as a representative example.

Recently, particularly excellent hydration property and surface smoothness have been required due to the high speed operation of a machine for fabric. The Patent Publication 1 discloses a fabric for papermaking which improves hydration property by the fact that the number of upper surface side warps is set to be less than that of lower surface side warps. According to this fabric, longitudinally extending grooves are formed on the upper surface side to improve hydration property, since the number of the upper surface side warps is less. However, said fabric gets easily longitudinally lengthened, since the rigidity in the longitudinal direction of the fabric becomes lowered because of the small number of the upper surface side warps. Thus, said fabric has not been applied to an industrial fabric.

In addition, in the papermaking process, since the upper surface side serves to receive the raw material and serves as a surface contacting wet paper, the fiber supportability and the surface smoothness are required. In this respect, technical problems which cause the fact that the raw material is pulled, or that marks are attached to the paper cannot be solved simply by decreasing the number of the upper surface side warps.

Patent Publication 1: Japanese Patent Laid-open Publication 2005-350844

DISCLOSURE OF THE INVENTION

Technical Problems to be Solved by Present Invention

The object of the present invention is to provide an industrial two-layer fabric which exhibits good hydration property and good air permeability by forming a longitudinal groove on its upper surface side through a weave design without decreasing the number of warps, while at the same time exhibits good fiber supportability, good surface smoothness and high rigidity

Means to Solve Technical Problems

The technical feature of the industrial two-layer fabric according to the present invention lies in the fact that longitudinally extending grooves are formed on its upper surface side through a weave design without decreasing the number of the warps. Such a structure allows for good hydration property and good air permeability. Since such a structure can increase the shooting count of wefts, a fine surface can be obtained, so that the surface smoothness can be improved. In addition, for instance, in a case where the design on the upper surface side is defined by a plain weave design, a fiber supportability can be improved due to the fact that a distance between adjacent upper surface side warps constituting a plain weave design can be long because of the existence of the longitudinal grooves, and that a length of a crimp of the upper surface side warp can be long as compared to a normal fabric of a plain weave design, whereby the shooting count of wefts can be increased.

In order to solve the above technical problems, the present invention is defined by the following elements.

The present invention provides an industrial two-layer fabric constituted by at least one upper surface side warp to be woven with at least one upper surface side weft, at least one lower surface side warp to be woven with at least one lower surface side weft, and at least one warp binding yarn to be woven with the at least one upper surface side weft and the at least one lower surface side weft comprising at least one pair of upper and lower warps in which said upper and lower surface side warps are located to be upper and lower, respectively, and at least one pair of warp binding yarns in which at least one yarn constitutes the warp binding yarn, characterized in that all knuckles emerging on the upper surface side formed by the yarns of said pair of warp binding yarns are aligned with knuckles on the upper surface side formed by the upper surface side warp adjacent to said pair of warp binding warps to form a hydrating groove.

The present invention provides an industrial two-layer fabric constituted by at least one upper surface side warp to be woven with at least one upper surface side weft, at least one lower surface side warp to be woven with at least one lower surface side weft, and at least one warp binding yarn to be woven with the at least one upper surface side weft and the at least one lower surface side weft comprising at least one pair of upper and lower warps in which said upper and lower surface side warps are located to be upper and lower, respectively, and at least one pair of warp binding yarns in which at least one yarn constitutes the warp binding yarn, characterized in that all or a portion of said upper surface side warps constituting said pair of upper and lower warps constitutes incomplete upper surface side warps in which a portion of knuckles are absent on the upper surface side, said pair of warp binding yarns are arranged so as to be adjacent to said incomplete upper surface side warps, a portion of knuckles emerging on the upper surface side formed by the yarns of said pair of warp binding yarns complements a portion where said knuckles of said incomplete upper surface side warps are absent, other knuckles emerging on the upper surface side are aligned with knuckles on the upper surface side formed by the upper surface side warp adjacent to said pair of warp binding warps to form a hydrating groove.

According to another preferred configuration, said incomplete upper surface side warps define a design in which two knuckles are absent in a complete design of the fabric.

According to another preferred configuration, a portion of said knuckles on the upper surface side of the yarns of said pair of warp binding yarns are aligned with the knuckles of the upper surface side warp adjacent thereto, said other knuckles emerging on the upper surface side complement a portion where knuckles are absent on said incomplete upper surface side warp adjacent thereto.

According to another preferred configuration, one yarn of said pair of warp binding yarns forms knuckles aligned with the knuckles on the upper surface side warp adjacent thereto, the other yarn complements the portion where the knuckles are absent on the incomplete upper surface side warp.

According to another preferred configuration, each of the yarns of said pair of warp binding yarns is aligned with the knuckles of said upper surface side warp, or complements the knuckles of said upper surface side warp.

According to another preferred configuration, said pair of warp binding yarns comprises two warp binding yarns, or one warp binding yarn and one upper surface side warp, or one warp binding yarn and one lower surface side warp.

According to another preferred configuration, the industrial two-layer fabric comprises a complete design in which said warp binding yarn passes over one or two upper surface side wefts once or twice, and then goes down to the lower layer to pass under one or two lower surface side wefts.

According to another preferred configuration, said pair of upper and lower warps and said pair of warp binding yarns are arranged in an alternate manner.

With respect to the incomplete upper surface side warp, if too less knuckles are formed on the surface, a distance between the upper surface side weft and the lower surface side weft becomes large, so that the easily deformable fabric the rigidity of which is deteriorated is formed because of the fact that the number of the intersections is decreased. Such being the case, it is preferable that the design on the upper surface side be the one in which comparatively many intersections are included such as the plain weave design, etc. The number of the absent knuckles in the complete design may be preferably two, since two warp binding yarns, or the warp binding yarn and the upper surface side warp, or one warp binding yarn complements the portion where the knuckles are absent.

With respect to other design on the upper surface side, there may be a design in which the warp passes over two upper surface side wefts and then passes under two upper surface side wefts. Further, the design in which the incomplete upper surface side warp is complemented by the warp binding yarns may be a plain weave design, while the design in which the complete upper surface warp is formed may be other designs.

The present invention relates to a fabric in which a longitudinal hydration groove is formed on the upper surface side through the weave design without decreasing the number of the warps. The warps constituting the fabric of the present invention comprises the upper surface side warp to be woven with the upper surface side weft, the lower surface side warp to be woven with the lower surface side weft, and the warp binding yarn to be woven with the upper surface side wefts and the lower surface side wefts.

In the present invention, there are two types for forming the dehydration groove, one being (1) a type of alignment, the other being (2) a type of alignment plus complementing. In any type, the knuckles on the upper surface side of the warp of the pair of warp binding warps are aligned with the knuckles of the upper surface side warp adjacent thereto so as to create portions where they are close together, so that a space is generated at portions where they shift, whereby longitudinal grooves are formed as a whole. As to the type (2), in addition to such an alignment, a portion where knuckles of the adjacent upper surface side warp are absent is complemented by knuckles forming the yarns of the pair of warp binding yarns. In both types, the portion of the knuckles being close together and the portion of the knuckles being apart from each other are formed, and a principle in which the longitudinal groove is formed is common among both types. With respect to the type (1), the knuckles on the upper surface side of the warp of the pair of warp binding warps are simply arranged to be close together with the knuckles of the upper surface side warp adjacent thereto, while with respect to the type (2), the warp binding yarns form knuckles at a portion where the knuckles of the upper surface side warp are absent. Such being the case, there is an only difference of a design of the adjacent upper surface side warp between the two types.

In the present invention, there are at least one pair of upper and lower warps consisting of the upper surface side warp and the lower surface side warp and at least one pair of warp binding yarns including at least one warp binding yarn.

In the pair of warp binding yarns, there are a case where two warp binding yarns are arranged so as to form an intersection, a case where one warp binding yarn and one lower surface side warp are included, and a case where one warp binding yarn and one upper surface side warp are included.

With respect to the upper surface side warp, the pair of upper and lower warps consisting of one upper surface side warp and one lower surface side warp is included, and as to the type (2), there are a case where the upper surface side warp includes complete upper surface side warps and incomplete upper surface side warps, and a case where the upper surface side warp includes only the incomplete upper surface side warps. The incomplete upper surface side warp is defined to be the yarn a portion of knuckles of which formed on the upper surface side is absent. For instance, in case of a plain weave design, the warp normally passes over one weft and then passes under one weft in an alternate manner, however, the warp passes one weft, and then, passes under three wefts, and then passes over one weft. In this case, one knuckle is absent.

In addition, a complete upper surface side warp is defined to be a yarn constituting a complete design of a warp to be woven with an upper surface side weft to form a design on an upper surface side. In other words, it means a general upper surface side warp repeating a constant pattern without causing absence of knuckles. For instance, in case of a plain weave design, it is constituted by a repetition of a pattern that the upper surface warp passes over one weft and under one weft in an alternate manner. All the upper surface side warp of the pair of upper and lower warps belonging to the type (1) are the complete upper surface side warps.

A knuckle is defined to be a woven portion which is bent along a weft at a position where a warp passes over or under one (or two) wefts.

With respect to the upper surface side warp, the upper surface side warp of the pair of warp binding yarns other than that of the pair of upper and lower warps exists. With respect to the pair of warp binding yarns, the pair consisting of two warp binding yarns, the pair of consisting of one warp binding yarn and one lower surface side warp, and the pair of one warp binding yarn and one upper surface side warp exist. Since the upper surface side warp of the pair of warp binding yarns is arranged to be near the upper surface side warp of the pair of upper and lower warps adjacent thereto, the design and the function of the upper surface side warp of the pair of warp binding yarns are different from those of the upper surface side warp of the pair of upper and lower warps.

No particular limitation is put on the design of warp binding yarns, however, it is preferable that the warp binding yarn passes over one or two upper surface side wefts once or twice, and then, goes down to the lower layer to pass under one or two lower surface side wefts. Since the warp binding yarn emerges on the upper layer and then goes down to the lower layer, a large inner space can be formed inside the fabric layer including the longitudinal groove, so that sufficient water drainage property and sufficient air permeability are obtained.

Since the warp binding yarn is the yarn which does not stay but shifts toward the side of the upper surface side warp adjacent thereto, it is preferable that not too many knuckles be formed on the surface and that the number of the knuckles be determined depending on the design of the upper surface side or the design of the upper surface side warp. It is preferable that the warp binding yarn forms a portion where it passes over one, or two at most upper surfaces side wefts once or twice. For instance, it is preferable that the warp binding yarn constitute a design in which no less than two knuckles which are spaced apart from each other with a distance corresponding to no less than one upper surface side weft are formed on the upper surface side.

All of the knuckles on the upper surface side formed by the warp binding yarn of the pair of warp binding yarns and the upper surface side warp are aligned with each other, or complement each other, however, a principle in which a longitudinal groove is formed through the alignment of the knuckles will be now described.

Since the upper surface side warp and the warp binding yarn adjacent thereto, or the upper surface side warp and the upper surface side warp of the pair of the warp binding yarns adjacent thereto pass over the same one or two upper surface side wefts, at the intersection of the warp and the weft, the weft is caused to be bent to form a valley, and the knuckles of the two warps gather on the valley to be close together to form an adjacent portion, whereby the warps adjacent to each other are caused to be spaced apart from each other due to the fact that the warp at the intersection shifts, and as a result, a longitudinal groove is formed at the portion where the warps are spaced apart from each other.

In addition, the longitudinal groove tends to be formed due to the fact that the knuckles of the warp are formed so as to be diagonally adjacent to each other upon being seen from the surface in such a way that the knuckles are formed on the upper surface side weft adjacent to the respective warps between the warps adjacent to each other of the portion being spaced apart from each other. This design is adopted because the knuckles repel each other so that a force to back up the shift is generated.

For instance, as shown in FIG. 18, in a case where two warps and two wefts cross in such a way that the weft 4 passing over the warp 1 to which a tension force is applied passes under the warp 2 adjacent to the warp 1, while the wefts passing over the warp 2 passes under the warp 1, the weft 4 is caused to be pushed up at a portion where the weft 4 and the warp 1 cross to form a mountain, while a valley is formed at a portion where the weft 4 passes under the warp 2. On the other hand, the weft 3 is caused to be pushed up at a portion where the weft 3 and the warp 2 cross to form a mountain, while a valley is formed at a portion where the weft 3 passes under the warp 1. Such being the case, since the warp at the valley tends to shift so as to be away from the mountain due to the fact that the positional relationship between the warp and the weft is set to be reverse in the vertical direction at four cross points each of which point is defined by either of two warps adjacent to each other and either of two wefts adjacent to each other, the warps 1 and 2 adjacent to each other tend to shift so as to be away from each other (refer to arrows in FIG. 18). This is why the repelling force is generated. The repelling force causes the knuckles of the warp binding yarns or the upper surface side warps to shift to any position, whereby a longitudinally extending groove is formed.

Likewise, a principle in which the knuckles complement to form a longitudinal groove is now described. If a space where the knuckles are absent on the upper surface side warps exist in the upper surface side layer, a phenomena in which the knuckles of the warp binding yarns are caused to shift so as to embed the space in such a way that the yarns tend to become uniform is generated. In addition, because of the design in which a force to back up the shift of the knuckles of the warp binding yarns is generated, the knuckles tend to shift. The force to back up is the same as that described above.

The longitudinal groove is formed based on the common principle described above in case of either the complementing, or the alignment. In case of the complementing, the incomplete upper surface side warp in which a portion of the knuckles formed on the upper surface side are absent exists.

The pair of warp binding yarns never fails to be arranged to be at least one side of the incomplete upper surface side warp, and an uniform constant pattern is formed on the upper surface side due to the fact that the warp binding yarn of the pair of warp binding yarns or the upper surface side warp pass over the upper surface side weft to form knuckles so as to complement the absent knuckles of the incomplete upper surface side warp. In the incomplete upper surface side warp, at least one absent knuckle is complemented by the warp binding yarn adjacent thereto or the upper surface side warp.

In case of an application in which an uniform surface is required, it is necessary to take account of the design of the incomplete upper surface side warp forming the upper surface side, the warp binding yarn, the upper surface side warp, the combination or the arrangement of these, etc. in order to make the surface formed by the complementing uniform.

The arrangement for attaining the effect of the present invention in a maxim manner is the one in which the pair of upper and lower warps and the pair of warp binding yarns are arranged in an alternate manner.

With respect to the incomplete upper surface side warp, if too less knuckles are formed on the surface, a distance between the upper surface side weft and the lower surface side weft becomes large, so that the easily deformable fabric the rigidity of which is deteriorated is formed because of the fact that the number of the intersections is decreased. Such being the case, it is preferable that the design on the upper surface side be the one in which comparatively many intersections are included such as the plain weave design, etc. The number of the absent knuckles in the complete design may be preferably two, since two warp binding yarns, or the warp binding yarn and the upper surface side warp, or one warp binding yarn complements the portion where the knuckles are absent.

With respect to other design on the upper surface side, there may be a design in which the warp passes over two upper surface side wefts and then passes under two upper surface side wefts. Further, the design in which the incomplete upper surface side warp is complemented by the warp binding yarns may be a plain weave design, while the design in which the complete upper surface warp is formed may be other designs.

With respect to the upper surface side design, it may be determined based on the design of the incomplete upper surface side warp, the warp binding yarn of the pair of warp binding yarns, the design of the upper surface side warp, etc., but it may be preferably a plain weave design with many intersections, as described above. In particular, the design in which the incomplete upper surfaces side warp is complemented by the warp binding yarn may be a plain weave design, but the complete upper surface side may be other design.

The absent knuckles of the incomplete upper surface side warp are complemented by the warp binding yarn of the pair of the warp binding yarn adjacent thereto, or the upper surface side warp, however, another knuckle of one yarn may aligned with the knuckles on the upper surface side of the incomplete upper surface side warp. In other words, the incomplete upper surface side warp may be either aligned with the warp adjacent thereto, or complemented by the warp adjacent thereto.

For instance, there cases where one of the pair of warp binding yarns complements a absent portion of the incomplete upper surface side warp adjacent to a portion of the knuckles formed on the upper surface side while other knuckles are aligned with be near the knuckles of the incomplete upper surface side warp, where the one of the pair of warp binding yarns complements the absent knuckles of the incomplete upper surface side warp while the other of the pair of warp binding yarns forms the knuckles aligned with be near the knuckles of the upper surface side warp adjacent thereto in the opposite side, etc.

In addition, two of the pair of warp binding yarns may be aligned with the upper surface side warp arranged to be one side, or may be complemented by said upper surface side warp, or one of the pair of warp binding yarn may be aligned with the upper surface side warp on the right side, or may be complemented by said upper surface side warp while the other of the pair of warp binding yarn may be aligned with the upper surface side warp on the left side, or may be complemented by said upper surface side warp, whereby said two yarn may be divided in such a way that one is shifted in the right direction toward one yarn, while the other is shifted in the left direction toward to another yarn.

For instance, in case of the type (1), there may be cases where two yarns constituting the pair of warp binding warps are aligned with be near the knuckles of the upper surface side warp adjacent to be one side, or where one of the pair of warp binding yarns is aligned with be near the knuckles of the upper surface side warp adjacent to be right side while the other of the pair of warp binding yarns is aligned with be near the knuckles of the upper surface side warp adjacent to be left side.

However, it is not preferable that one knuckle of one yarn is aligned with the upper surface side warp arranged to be right side, or is complemented by said upper surface side warp while another knuckle of one yarn is aligned with the upper surface side warp arranged to be left side, or is complemented by said upper surface side warp. This is because there is a risk that the formation of the longitudinal groove which is related to the object of the present invention is impeded due to the fact that the above design causes a structure in which one warp binding yarn tends to meander in the right and the left direction to form knuckles.

In addition, the lower surface side layer consists of the lower surface side warp and the warp binding yarn and no limitation is pun on its design. The lower surface side layer may be a ribbed design constituting a plain weave design by two warps on the lower surface side being aligned with each other, or the lower surface side weft may form a long crimp on the lower surface side. Alternatively, the single lower surface side warp may pass under one lower surface side weft, or pass over a plurality of the lower surface side wefts.

With respect to a diameter of the yarn constituting the fabric, it is preferable that the upper surface side weft defining the upper surface side, the upper surface side warp, and the warp binding yarn include a comparatively small diameter in order to render the upper surface fine and smooth. With respect to the weft, It is preferable that the diameter of the weft on the upper surface side be comparatively small in order to render the upper surface fine. In addition, since the lower surface side layer serves to contact a roll of a machine, so that high rigidity and wear resistance are required for the lower surface side layer, it is preferable that the diameter of the lower surface side weft be comparatively large. Further, the diameters of the upper surface side warp, the lower surface side warp, and the warp binding warps may be set to be the same, while the diameter of the only lower surface side warp may be large. A ratio of the upper surface side wefts to the lower surface side wefts may be appropriately determined, such as 1:1, 2:1, 3:2, 3:1, 4:3 and 4:1. A latitudinal groove serving as a hydration groove may be formed by setting the number of the lower surface side wefts to be less than that of the upper surface side wefts, and the hydration property and the water drainage property can be even more improved by a combination of the latitudinal groove with the longitudinal groove.

In addition, it is preferable that the ratio of the lower surface side wefts be decreased, since a longitudinal groove is formed due to the fact that a distance between the portion where the warp binding yarn is woven with the upper surface side weft and the portion where the warp binding yarn is woven with the lower surface side weft is lengthened so that the warp binding yarn tends to shift toward the warp adjacent thereto.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

The various kinds of material may be used for the papermaking wire, however, polyester monofilaments which exhibits high rigidity and dimensional stability may be preferably used for the upper surface side warp, the lower surface side warp, the warp binding yarns, and the upper surface side weft. In addition, it is preferable that polyester monofilaments and polyamide monofilaments are arranged in an alternate manner for the lower surface side weft which requires high wear resistance property in order to improve rigidity and wear resistance.

Effects Of the Invention

According to the present invention, an industrial two-layer fabric which exhibits good dehydration property and good air permeability as well as good surface smoothness, good fiber supportability, high rigidity by providing a fabric in which grooves extending longitudinally or in the direction which the fabric extends are provided on its upper surface side through a weave design without decreasing the number of warps.

DETAILED DESCRIPTION OF THE INVENTION

Examples of the present invention will hereinafter be described based on accompanying drawings.

Each of FIGS. 1 to 8 is a view showing a embodiment of the type (1) according to the present invention. Each of FIGS. 1, 3, 5, and 7 is a design view, while each of FIGS. 2, 4, 6, and 8 is a cross-sectional view along the warps. FIG. 17 is a view showing an inner space of the fabric formed by the upward and downward shift of the warp binding yarns.

The design diagram is a minimum repeating unit of a fabric design (referred to as a complete design) and a whole fabric design is formed by intertwining this complete design longitudinally and latitudinally as well as upwardly and downwardly. In these design diagrams of the following embodiments 1 to 4, warps are indicated by Arabic numerals, for example 1, 2, and 3. The complete upper surface side warp is indicated by the numeral to which "u" is attached, the incomplete upper surface side warp is indicated by the numeral to which "u" is attached, the warp binding yarn is indicated by the numeral to which "b" is attached, the upper surface side warp to cooperate with the warp binding yarn to form a pair is indicated by the numeral to which "u"" is attached, the warp binding warp to cooperate with the warp binding yarn "b" or the upper surface side warp "u"" to form a pair is indicated by the numeral to which "B" is attached, and the lower surface side warp is indicated by the numeral to which "d" is attached.

With respect to the warp, there are a pair of upper and lower warps consisting of one upper surface side warp (u) and one lower surface side warp (d), a pair of warp binding yarns consisting of two warp binding yarns (b,B), a pair of upper and lower warps consisting of one incomplete upper surface side warp (u") and one lower surface side warp (d), and a pair of warp binding yarns consisting of one upper surface side warp (u") and one warp binding yarn (B).

Wefts are indicated by Arabic numerals, for example 1', 2', and 3'. Depending on a ratio of the wefts, there are two cases, the one where the upper surface side weft and the lower surface side weft being arranged to be upper and lower, respectively, and the other where only the upper surface side wefts exist. The upper surface side weft is indicated by the numeral to which "u" is attached, while the lower surface side weft is indicated by the numeral to which "d" is attached, such as 1'*u*, 2'*d*.

In the diagrams, a cross "X" means that an upper surface side warp (u,u',u") lies over an upper surface side weft to form a knuckle on the upper surface side, while an open square "□" indicates that a lower surface side warp (d) lies under a lower surface side weft to form a knuckle on the lower surface side. A solid circle "●" indicates that a warp binding yarn (b) lies under an upper surface side weft to form a knuckle, while an open circle "○" indicates that a warp binding yarn (b) lies under a lower surface side weft to form a knuckle. A solid rhombus "◆" indicates that a warp binding yarn (B) lies over an upper surface side weft to form a knuckle. An open rhombus "◇" indicates that a warp binding yarn (B) lies under a lower surface side weft to form a knuckle.

A thick frame in the design diagrams indicates a portion where the knuckles of the warp binding yarn are aligned with the knuckles of the upper surface side warp, and a mesh indicates a portion where the knuckles are absent in FIGS. 9 to 18.

In the design drawings, the lower surface side warps and wefts lie directly underneath the upper surface side warps and wefts, respectively. This is for the convenience of the drawings, and in an actual fabric, the lower surface side warps and wefts may biasedly lie under the upper surface side warps and wefts.

First Embodiment

Each of FIGS. 1 and 2 is a design view showing a fabric consisting of sixteen warps, or sixteen shafts of a first embodiment according to the present invention. Each of the warps 2,4,6, and 8 is a pair of upper and lower warps consisting of the upper surface side warp (u) and the lower surface side warp (d). Each of the warps 1,3,5, and 7 includes one warp binding yarn (b) and one lower surface side warp (d). The pair of upper and lower warps and the pair of warp binding yarns are arranged in an alternate manner.

The upper surface side warp is a plain weave design and passes over and under one upper surface side weft in an alternate manner. In addition, the warp binding warps passes over one upper surface side weft, and then, goes down to the lower layer to pass under one lower surface side weft, whereby the upper and lower layers are woven with each other. The knuckles on the upper surface of the warp binding yarn are aligned with a portion of the knuckles of the upper surface side warp, as shown in FIGS. 1 and 2, the warp binding yarn 1*b* is aligned with be near the knuckles which the upper surface side warp (2*u*) adjacent thereto forms on the upper surface side weft (7'*u*). In addition, the warp binding yarn (3*b*) is aligned with be near the knuckles which the upper surface side warp (2*u*) forms on the upper surface side weft (5'*u*). This causes a longitudinal groove to be formed on a portion of the warps (1) and (3).

By the above embodiment, the number of the shooting counts of the wefts can be increased, as compare with the normal plain weave design, and even though the upper surface side warp is a plain weave design, a fiber supportability can be improved, since a long crimp of the upper surface side weft can be obtained, as compared with the normal plain weave design.

In addition, the warp binding yarn is woven with the upper surface side weft to form a knuckle, and then goes down to the lower layer to be woven with the lower surface side weft, and then, is woven with the upper surface side weft again. A large inner space is formed inside the fabric so that good water drainage property and good air permeability are obtained (refer to a diagonal section in FIG. 17) due to the fact that the warp binding warps is arranged between the longitudinal grooves in addition to the above described design.

The lower surface side layer defines a ribbed design in which the lower surface side warp and the warp binding yarn adjacent to each other pass under the same lower surface side weft in such a way that, high rigidity is obtained, while good water drainage property and good air permeability are obtained, since longitudinal grooves are formed on the lower surface side layer.

Second Embodiment

Each of FIGS. 3 and 4 is a design view showing a fabric consisting of sixteen warps, or sixteen shafts of a second embodiment according to the present invention. Each of the warps 1,3,5, and 7 is a pair of upper and lower warps consisting of the upper surface side warp (u) and the lower surface side warp (d). Each of the warps 2,4,6, and 8 is a pair of warp binding yarns (b, B). The pair of upper and lower warps and the pair of warp binding yarns are arranged in an alternate manner. This embodiment is different from the first embodiment in that, in this embodiment, the pair of warp binding yarns consists of two warp binding yarns.

The upper surface side warp is a plain weave design and a pair of warp binding yarns is arranged on both sides. The warp binding yarns passes over one upper surface side weft, and then, goes down to the lower layer to pass under one lower surface side weft, whereby the lower and upper layers are woven with each other. The knuckles of the warp binding yarns on the upper surface side are aligned with the knuckles of the upper surface side warp adjacent thereto, whereby a longitudinal space is formed inside the layer between the upper surface side warps. In this embodiment, the one of the pair of warp binding yarns is aligned with one knuckle of the upper surface side warp arranged to be right side, while the other of the pair of warp binding yarns is aligned with one knuckle of the upper surface side warp arranged to be left side. Such being the case, it may be that one of the pair is aligned with one yarn, while the other of the pair is aligned with another yarn.

The design of the lower surface side layer of this embodiment is the same as that of the first embodiment.

Like the first embodiment, since a longitudinal groove is formed between the upper surface side warps and an inner space is formed inside the layer, air permeability and water drainage property can be improved, and since the number of the shooting counts of the wefts can be increased, god surface smoothness and good fiber supportability can be obtained.

Third Embodiment

Each of FIGS. 5 and 6 is a design view of the fabric of the upper surface plain weave design consisting of sixteen shafts of a third embodiment according to the present invention. The structure of this embodiment is the same as that of the first embodiment except for the fact that the ratio of the upper surface side wefts of the lower surface side wefts is 4:1. Water drainage property can be further improved due to the fact that a latitudinal groove is also formed on the lower surface side because of the decreased number of the shooting counts of the lower surface side wefts. Wear resistance can be improved if the diameter of the weft is increased in accordance with the decreased number of the shooting counts of the lower surface side wefts.

Fourth Embodiment

Each of FIGS. 7 and 8 is a design view showing a fabric of an upper surface plain weave design consisting sixteen warps, or sixteen shafts of a fourth embodiment according to the present invention, like the second embodiment, but unlike the second embodiment, the ratio of the upper surface side wefts to the lower surface side wefts is 3:1, and the warp binding yarn forms a knuckle passing over one upper surface side weft twice.

The one of the warp binding yarn passes over one upper surface side weft, and then goes down to the lower layer to pass under one lower surface side weft, while the other of the warp binding yarn passes over two upper surface side wefts spaced apart from each other, and then goes down to the lower layer to pass under the lower surface side weft. The upper surface side knuckles of two warp binding yarns (b, B) are aligned with a portion of the knuckles of the upper surface side warp, as shown in FIGS. 7 and 8, the warp binding yarn (2*b*) is aligned with be near to the knuckles formed on the upper surface side weft (1'*u*), for instance. In addition, the warp binding yarn (2B) is aligned with be near to the knuckles formed on the upper surface side weft (5'*u*, 9'*u*) by the upper surface side warp (3*u*).

This causes the pair of warp binding yarns (2*b*,2B) and the pair of upper and lower warps (3*u*, 3*d*) to be near to each other, so that a longitudinal groove is formed at the warp (2).

Like the other embodiment, since the longitudinal groove is formed between the upper surface side warps and an inner space is formed inside the layer, good air permeability and good water drainage property are obtained, while surface smoothness and fiber supportability are improved because of the increased number of the shooting counts of the wefts.

Further, fifth to eighth embodiments of the present invention are described with reference to the drawings.

Each of FIGS. 9 to 16 is a view showing an example of the type (2) (the alignment and the complementing). Each of FIGS. 9, 11, 13 and 15 is a design view. FIGS. 10, 12, 14 and 16 are cross sectional views of warps 1 to 4, respectively.

Fifth Embodiment

FIG. 9 is a design view showing a fabric consisting sixteen warps, or sixteen shafts of a fifth embodiment according to the present invention. Each of warps 1,3,5 and 7 is a pair of upper and lower warps consisting of the upper surface side warp (u) and the lower surface side warp (d), the warps 1, 5 are the incomplete upper surface side warps (u'), while the warps 3, 7 are the complete upper surface side warps (u). In addition, each of warps 2,4,6 and 8 is a pair of warp binding yarns (b, B) consisting of two warp binding yarns, and the pair of upper and lower warps and the pair of warp binding yarns are arranged in an alternate manner. The ratio of the upper surface side wefts to the lower surface side wefts is 2:1.

The design formed on the upper surface side is a plain weave design in which the warp passes one upper surface side weft In addition, the warp binding yarn passes over one upper surface side weft, and then goes down to the lower layer to pass under one lower surface side weft. The upper layer and the lower layer are woven with each other. As shown in FIGS. 9 and 10, the one (B) of the pair of warp binding yarns complements absent knuckles of the incomplete upper surface side warp adjacent thereto, while the other (b) forms knuckles aligned with a portion of the knuckles of the upper surface side warp.

For instance, in the warp binding yarn 2, the warp binding yarn (2B) complements a portion where the knuckles of the incomplete upper surface side yarn (1*u*') are absent to be woven with the upper surface side weft (1'*u*). On the other hand, the warp binding yarn (2*b*) forms knuckles aligned with one of the knuckles of the complete upper surface side warp (3*u*) adjacent thereto to be woven with the upper surface side weft (6'*u*).

Further, the warp binding yarn (8B) arranged to be adjacent to the incomplete upper surface side warp (1*u*') is also woven with the upper surface side weft (7'*u*) to complement the absent knuckles. The incomplete upper surface side warp (1*u*') falsely forms a plain weave design corresponding to one warp on the upper surface side by being complemented from its both sides. In addition, the incomplete upper surface side warp is complemented from its both sides, so that a groove is formed between the warp 1 and the warp 3 on the upper surface side. Although the upper surface side design is a plain weave design, good fiber supportability is obtained, since the upper surface side weft forms a long crimp on its surface due to the grooved formed between the warps.

Likewise, the warp binding yarn (4*b*) arranged to be adjacent to the complete upper surface side warp (3*u*) is woven with the upper surface side weft (8'*u*) in order to form a knuckle aligned with one of the knuckle of the complete upper surface side warp (3*u*). The warp binding yarn (b, B) does not influence on the plain weave design formed on the upper surface side warp (3*u*), since it goes down to the lower layer so that the knuckles do not protrude.

In addition, the warp binding yarn is woven with the upper surface side weft to form knuckles, and then goes down to the lower layer to be woven with the lower surface side weft, and then is woven with the upper surface side weft again. A large inner space is formed inside the fabric so that good water drainage property and good air permeability are obtained (refer to a diagonal section in FIG. 17) due to the fact that the warp binding warps is arranged between the longitudinal grooves in addition to the above described design.

The lower surface side layer defines a ribbed design in which the lower surface side warp and the warp binding yarn adjacent to each other pass under the same lower surface side weft in such a way that, high rigidity is obtained, while good water drainage property and good air permeability are obtained, since longitudinal grooves are formed on the lower surface side layer.

Sixth Embodiment

FIG. 11 is a design view showing a fabric of the upper surface plain weave design consisting sixteen warps, or sixteen shafts of a sixth embodiment according to the present invention, like the fifth embodiment. Each of the warps 1, 5 define a pair of upper and lower warps consisting of the incomplete upper surface side warp (u') and the lower surface side warp (d). Each of the warps 3, 7 define a pair of upper and lower warps consisting of the complete upper surface side warp (u) and the lower surface side warp (d). Each of the warps 2, 4, 6 and 8 define a pair of warp binding yarns consisting of two warp binding yarns (b), (B). The pair of upper and lower warps and the pair of warp binding yarns are arranged in an alternate manner. One warp binding yarn forms two knuckles in such a way that one of the knuckles complements a portion where the knuckles of the upper surface side warp adjacent thereto are absent, while the other of the knuckles is aligned with a portion of the knuckles of the upper surface side warp adjacent thereto. Such being the case, the knuckle of one of the warp binding yarns may serve not only as the complement means, but also as the alignment.

The design formed on the upper surface side is a plain weave design and four knuckles are absent in one of the incomplete upper surface side warp. A pair of warp binding yarns are arranged on both sides, as shown in FIG. 12, one of the warp binding yarns (b) passes over one the upper surface side weft, and then, goes down to the lower layer to pass under one lower surface side weft, and then, goes up to the upper layer to pass over one upper surface side weft, and then, goes down to the lower layer again to pass under one lower surface side weft, whereby the upper and lower layers are woven with each other. In both of two warp binding yarns (B) constituting a pair, one of the knuckles complements a portion where the knuckles of the incomplete upper surface side warp (u') adjacent thereto, while the other of the knuckles forms a knuckle aligned with one knuckle of the incomplete upper surface side warp (u').

Taking into consideration that a groove is formed on the upper surface by making the warp binding yarn near the upper surface side warp adjacent thereto, even if there a plurality of knuckles of the upper surface side warps, a groove tends to be easily formed due to the fact that all the knuckles of one warp binding yarns are aligned with the knuckles of the upper surface side warp arranged to be the same side, or complement said knuckles, like this embodiment. In addition, in this embodiment, the ratio of lower surface side weft is set to be lower than that of the upper surface side weft. This causes a distance between the portion where the warp binding yarn and the upper surface side weft are woven with each other and the portion where the warp binding yarn and the lower surface side weft are woven with each other to be lengthened, whereby an angle between the warp binding yarn extending on the upper layer and the warp binding yarn extending on the lower layer is decreased, and as a result, the warp binding yarn tends to shift near the upper surface side warp adjacent thereto, and a longitudinal groove tends to be formed on the upper surface side layer.

Since the warp binding yarn passes over the upper surfaces side weft, and then goes down to the lower surface side layer, an inner space is formed inside the fabric layer. The design of the lower surface side layer is a ribbed design in which two lower surface side warps aligned with each other pass over and under one lower surface side weft.

Like the above embodiment, since the longitudinal groove is formed between the upper surface side warps and the inner space is formed inside the layer, air permeability and water drainage property are improved, while good surface smoothness and good fiber supportability are obtained due to the increased number of the shooting counts of the wefts.

Seventh Embodiment

FIG. 13 is a design view showing a fabric of a seventh embodiment according to the present invention. The fabric of this embodiment is the same as the upper surface plain weave design including sixteen shafts. More specifically, the warps 1,3,5,7 are the pair of upper and lower warps consisting of the incomplete upper surface side warp (u') and the lower surface side warp (d), while the warps 2,4,6,8 are the pair of warp binding warps consisting of the upper surface side warp (u") and the warp binding yarn (B). The pair of upper and lower warps and the pair of warp binding yarn are arranged in an alternate manner. The ratio of the upper surface side weft (u) to the lower surface side weft (d) is 2:1. In this embodiment, the upper surface side warp forms a plain weave design, and there exists the incomplete upper surface side warp in which two knuckles are absent.

In addition, the pair of warp binding yarns consists of the upper surface side warp and the warp binding yarn, and the upper surface side warp of said pair complements the absent knuckles of the incomplete upper surface side warp adjacent thereto, while the warp binding yarn forms the knuckles aligned with the knuckles of the incomplete upper surface side warp. In the above embodiment, the incomplete upper surface side warp complements the design, or forms the knuckles aligned with each other by the warp binding yarn arranged to be on both sides thereof, whereas, in this embodiment, not only the warp binding yarns but also the upper surface side warp cooperating with the warp binding yarn to form a pair forms the knuckles for the complementing. Further, like the sixth embodiment, in this embodiment, the knuckles are complemented by the warp binding yarn and the upper surface side warp arranged not to be both sides of the incomplete upper surface side warp, but to be one side thereof adjacent thereto. Like this embodiment, the absent knuckles may be complemented not by the warp binding yarn, but by the upper surface side warp constituting the pair of the warp binding warps.

More specifically, as shown FIG. 14, the incomplete upper surface side warp (1*u*') is a plain weave design where the knuckles are absent at the portion of the upper surface side weft (6'*u*) and the upper surface side weft (14'*u*). In addition, the reference number 2 indicates a pair of warp binding yarn consisting of the upper surface side warp (2*u*") and the warp binding yarn (2B), so that the upper surface side warp (2*u*") is woven with the upper surface side weft (6'*u*) and the upper surface side weft (14'*u*) to form a knuckle on the upper surface side. The upper surface side warp (2*u*") shifts toward the incomplete upper surface side warp (1*u*') so as to complement a portion where the knuckles are absent on the incomplete upper surface side warp (1*u*') adjacent thereto. In addition, in the warp binding yarn (2B), the upper surface side weft (2'*u*) and the upper surface side weft (10'*u*) are woven with each other to form a knuckle on the upper surface side. The incomplete upper surface side warp (1*u*') adjacent thereto also forms the knuckle at this portion so that the knuckles formed by the upper surface side warp (1*u*'), and the warp binding yarn (B) are aligned with each other. A longitudinal groove is formed on the upper surface side of the warp 2 in the design diagram due to the fact that these shift toward each other.

The above is applied to other warps so that the longitudinal grooves spaced apart from each other with an equal distance are formed on the upper surface side.

In addition, the warp binding yarn is woven with the upper surface side weft to form a knuckle, and then goes down to the lower layer to be woven with the lower surface side weft, and then, is woven with the upper surface side weft again. A large inner space is formed inside the fabric so that good water drainage property and good air permeability are obtained (refer to a diagonal section in FIG. 17) due to the fact that the warp binding warp is arranged between the longitudinal grooves in addition to the above described design.

In the lower surface side layer, two lower surface side warps aligned with each other go down to one lower surface side weft, and then, pass over three lower surface side wefts, so that good wear resistance is obtained due to the design in which the lower surface side weft forms a long crimp corresponding to six warps.

Like the above embodiment, since the longitudinal groove is formed between the upper surface side warps and the inner space is formed inside the layer, air permeability and water drainage property are improved, while good surface smoothness and good fiber supportability are obtained due to the increased number of the shooting counts of the wefts.

Eighth Embodiment

FIG. 15 is a design view showing a fabric of an eighth embodiment according to the present invention. The number of the shafts, the arrangement of the yarns, etc. are the same as those of the seventh embodiment. However, in the seventh embodiment, knuckles are formed on the upper surface side in such a way that the warp binding yarn of the pair of warp binding yarns are aligned with be near the knuckles of the upper surface side warp adjacent thereto, and the upper surface side warp cooperating with the warp binding yarn to define a pair complements a portion where the knuckles of the incomplete upper surface side warp adjacent thereto are absent, whereas, in this embodiment, as shown in FIG. 16, the warp binding yarn (B) of the pair of warp binding yarns (u",B) complements a portion where the knuckles of the incomplete upper surface side warp (u') adjacent thereto are absent, and the upper surface side warp (u") cooperating with the warp binding yarn (B) to define a pair is aligned with the knuckles of the upper surface side warp (u') adjacent thereto.

This embodiment is similar to the seventh embodiment, so that either one of the pair of warp binding yarns may complement a portion where the knuckles are absent, or may be aligned with the upper surface side warp adjacent thereto.

EXPLANATION OF SYMBOLS

Figure 1:
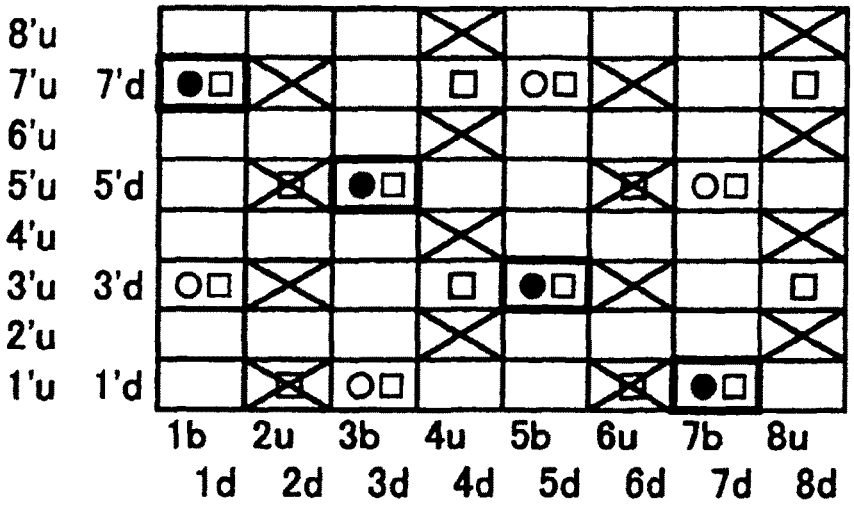
FIG. 1 is a design view showing a complete design of the first embodiment according to the present invention.
Figure 2:
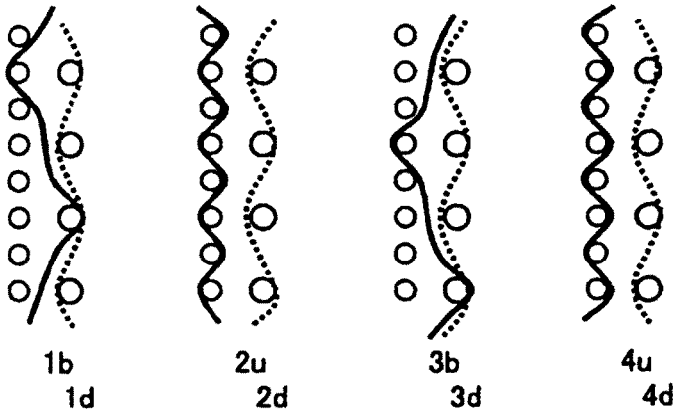
FIG. 2 is a cross sectional view taken along warps 1-4 of the first embodiment.
Figure 3:
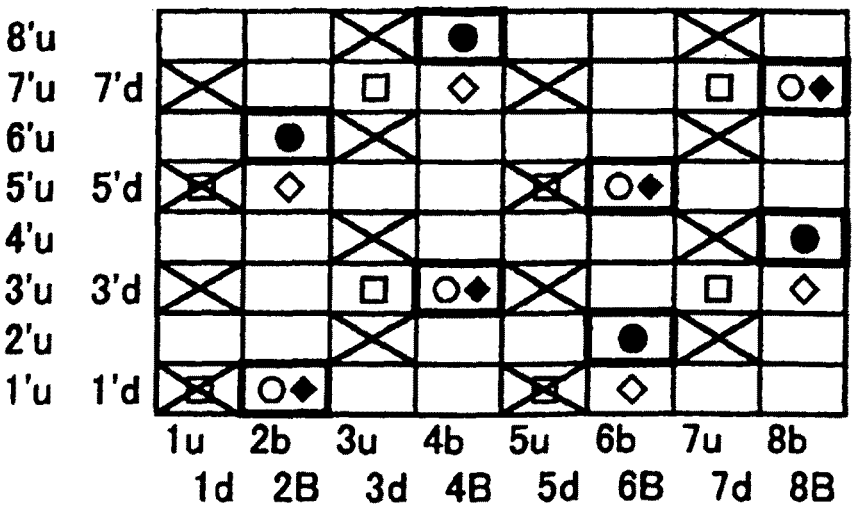
FIG. 3 is a design view showing a complete design of the second embodiment according to the present invention.
Figure 4:
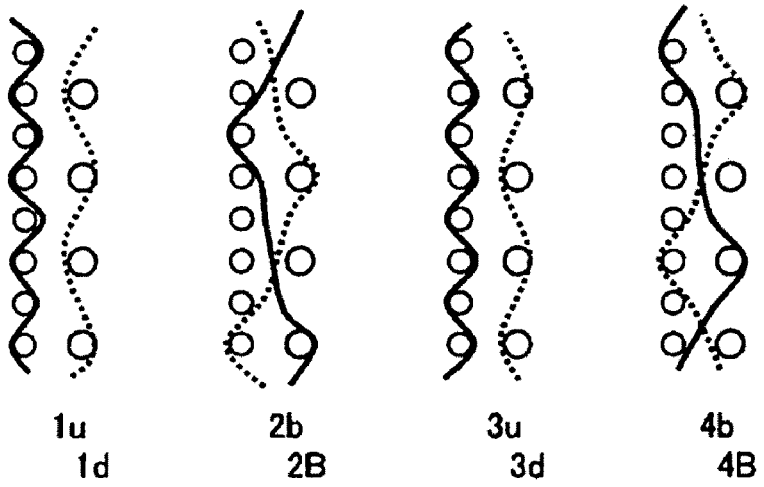
FIG. 4 is a cross sectional view taken along warps 1-4 of the second embodiment.
Figure 5:
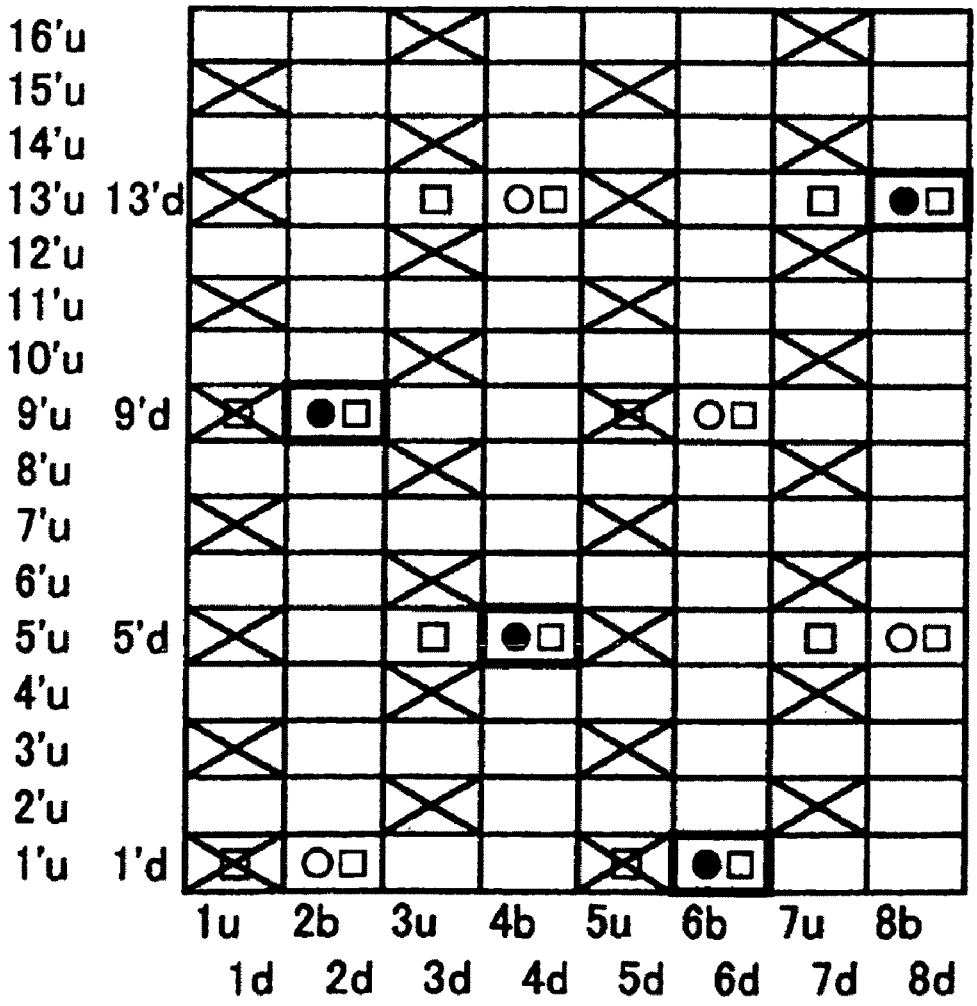
FIG. 5 is a design view showing a complete design of the third embodiment according to the present invention.
Figure 6:
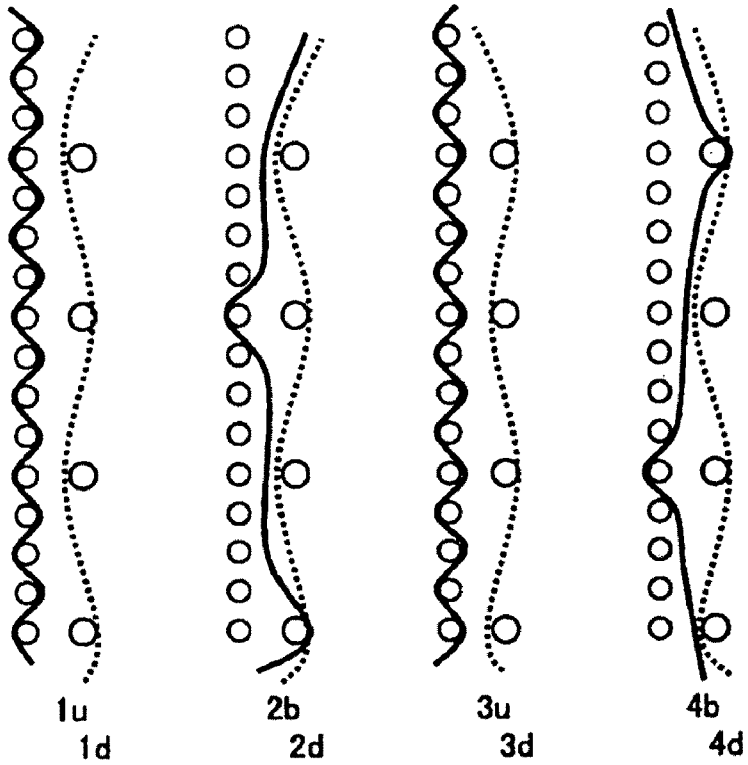
FIG. 6 is a cross sectional view taken along warps 1-4 of the third embodiment.
Figure 7:
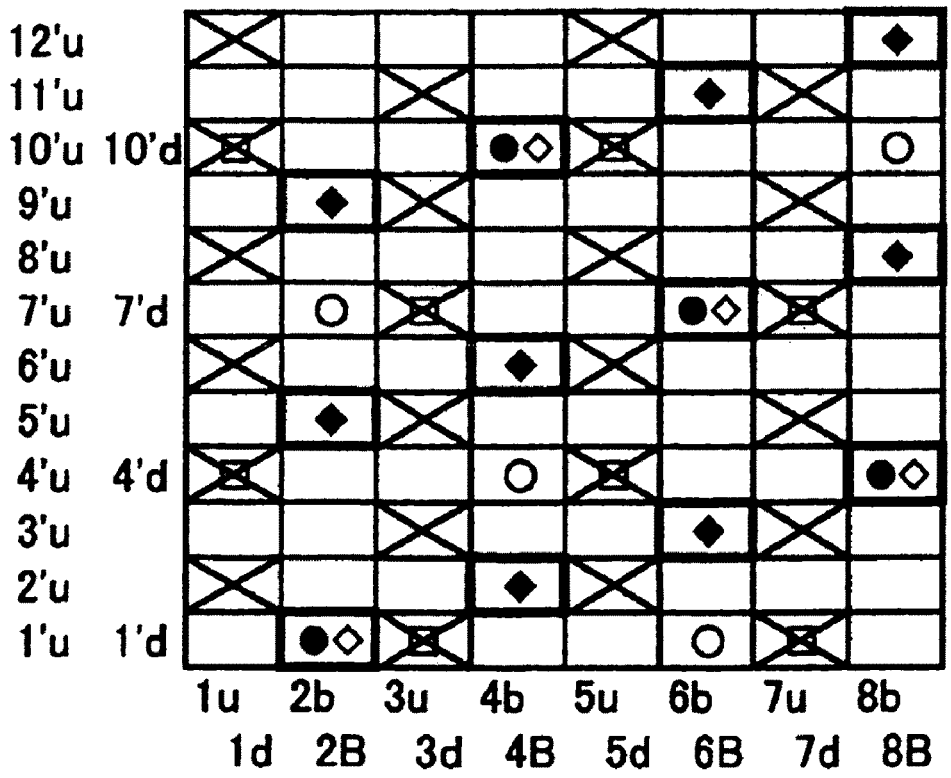
FIG. 7 is a design view showing a complete design of the fourth embodiment according to the present invention.
Figure 8:
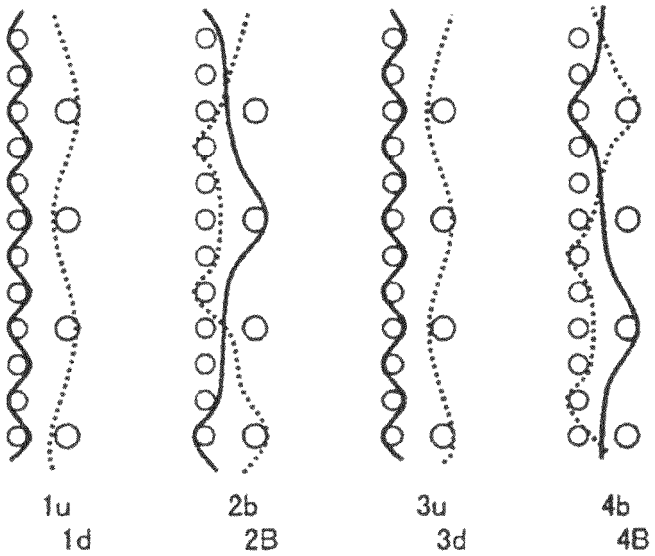
FIG. 8 is a cross sectional view taken along warps 1-4 of the fourth embodiment.
Figure 9:
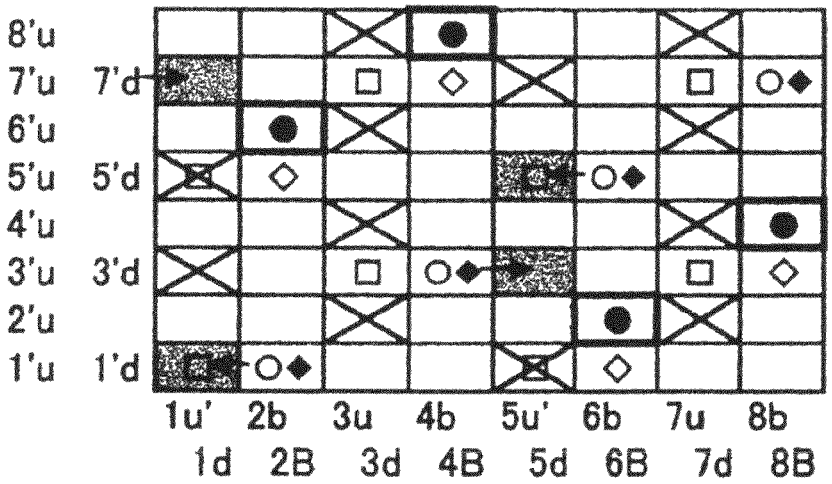
FIG. 9 is a design view showing a complete design of the fifth embodiment according to the present invention.
Figure 10:
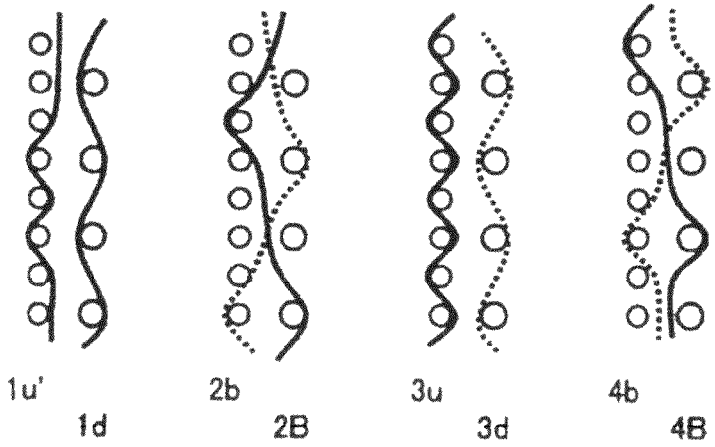
FIG. 10 is a cross sectional view taken along warps 1-4 of the fifth embodiment.
Figure 11:
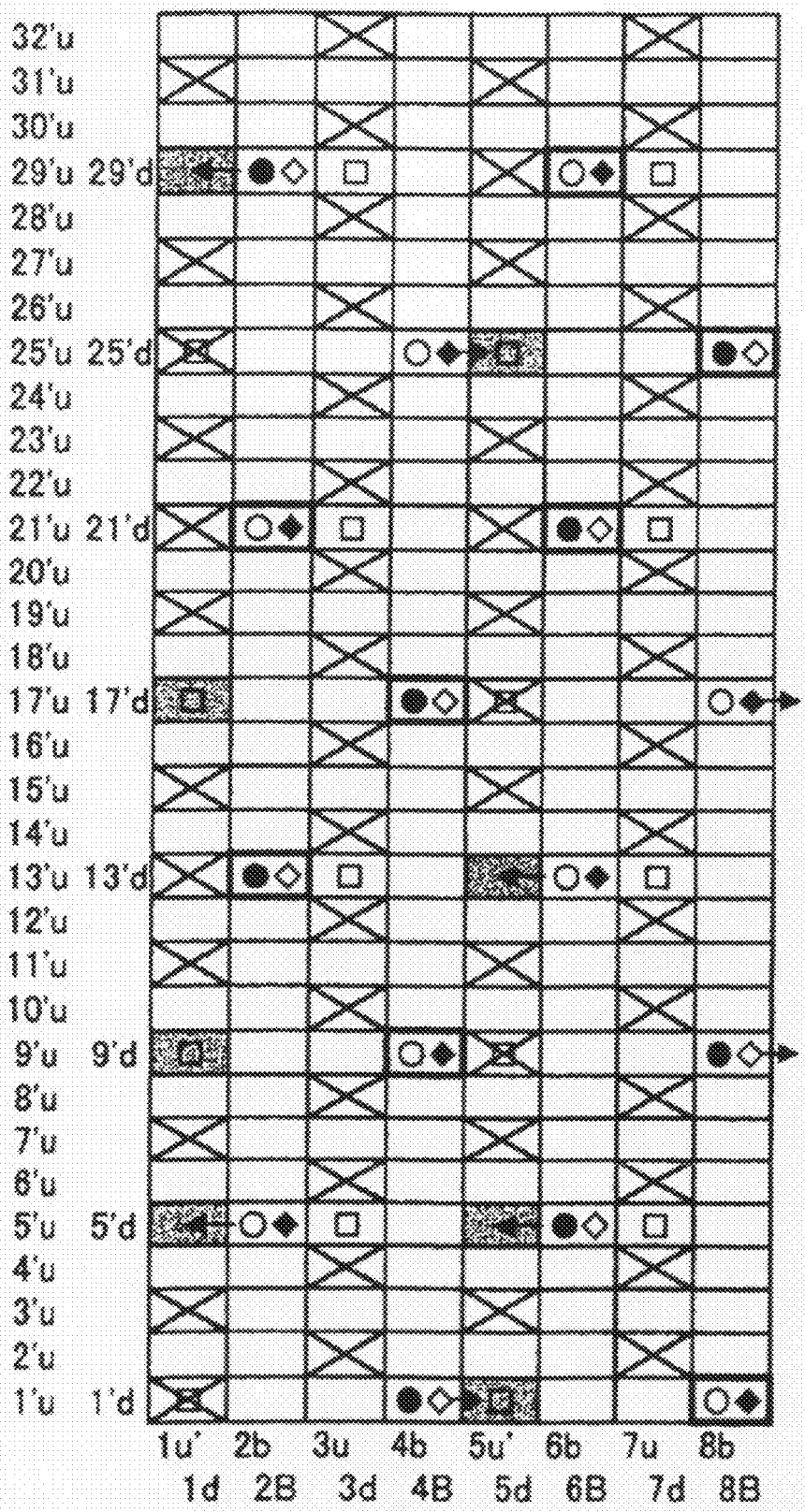
FIG. 11 is a design view showing a complete design of the sixth embodiment according to the present invention.
Figure 12:
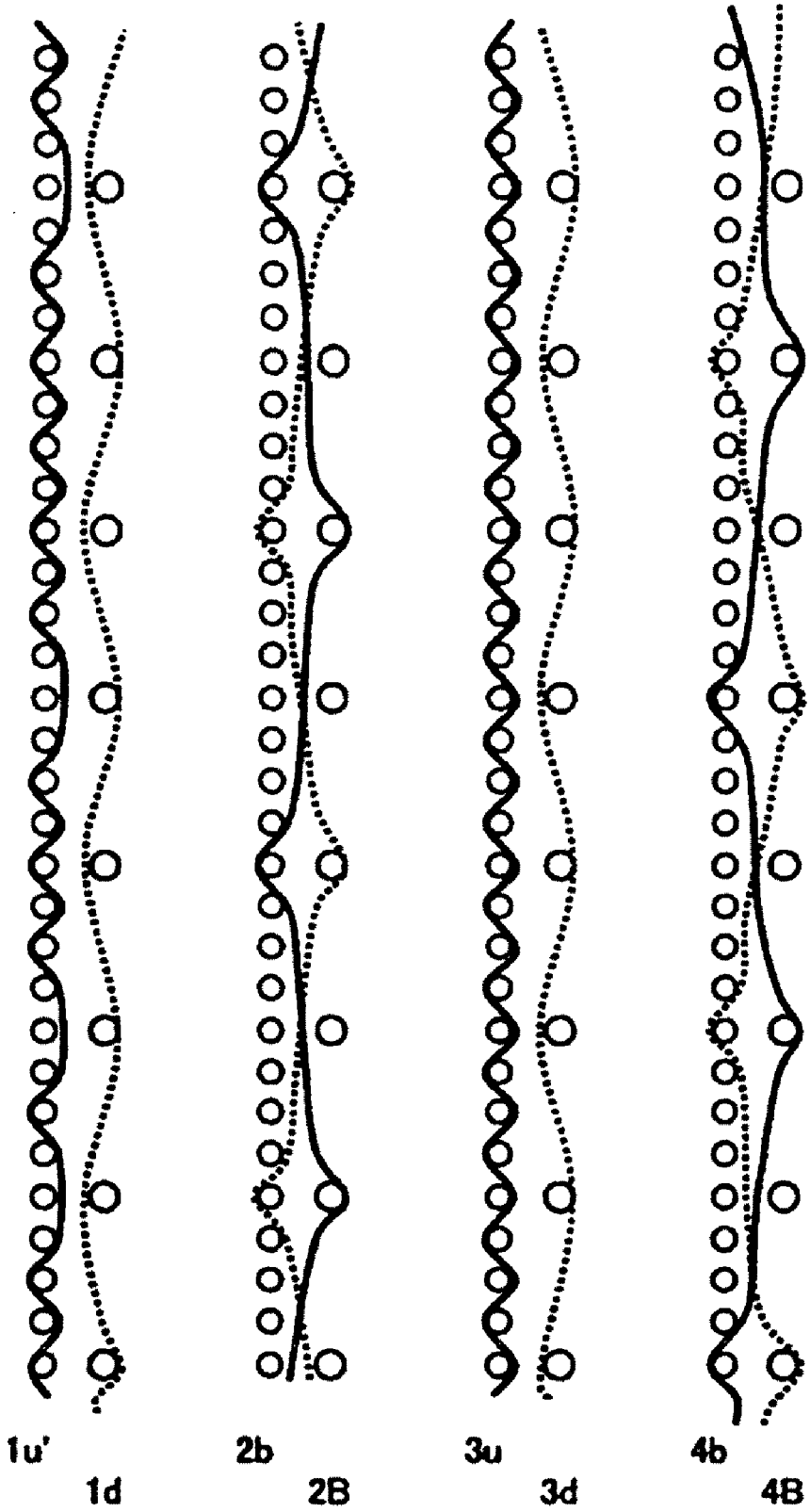
FIG. 12 is a cross sectional view taken along warps 1-4 of the sixth embodiment.
Figure 13:
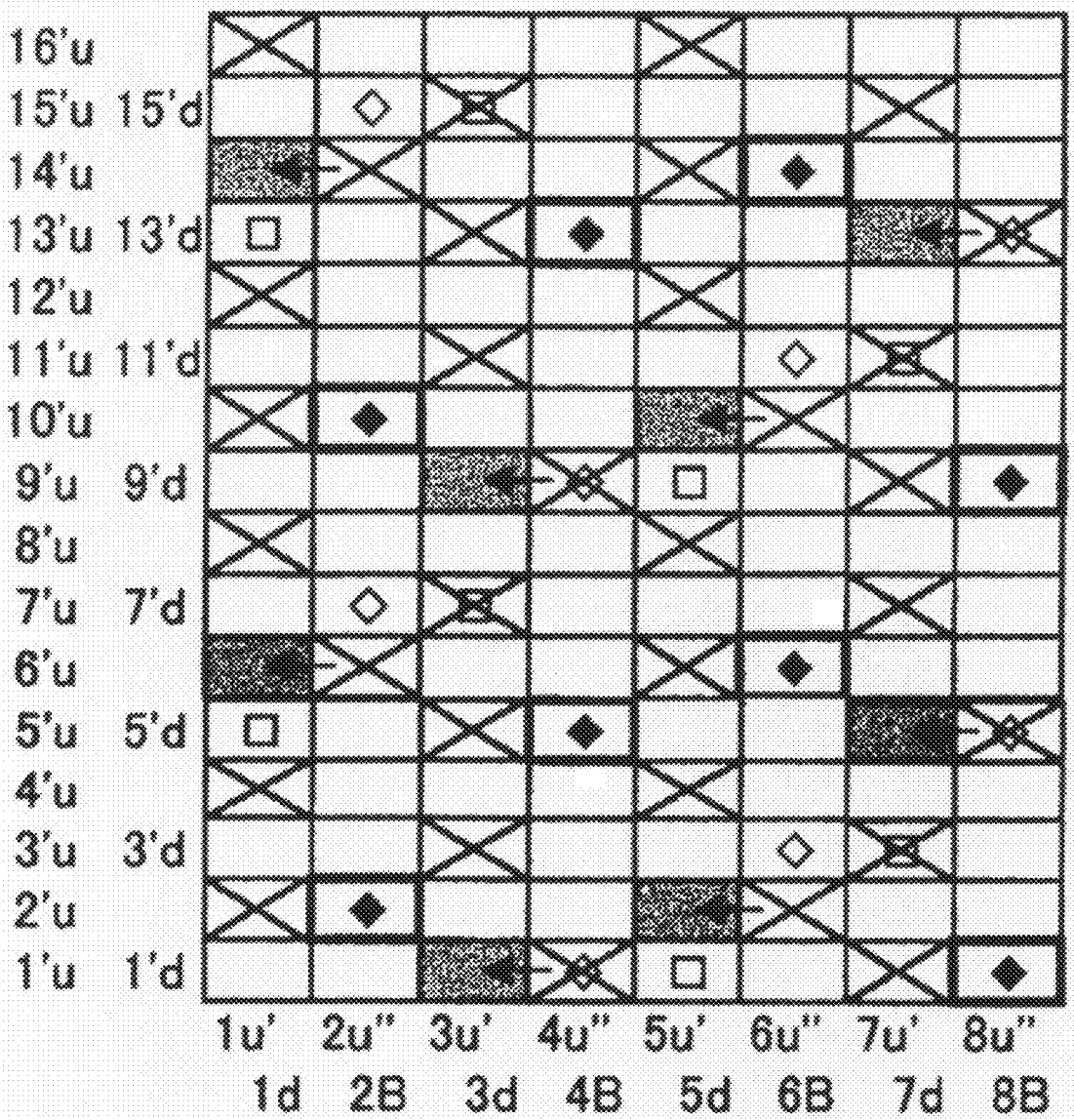
FIG. 13 is a design view showing a complete design of the seventh embodiment according to the present invention.
Figure 14:
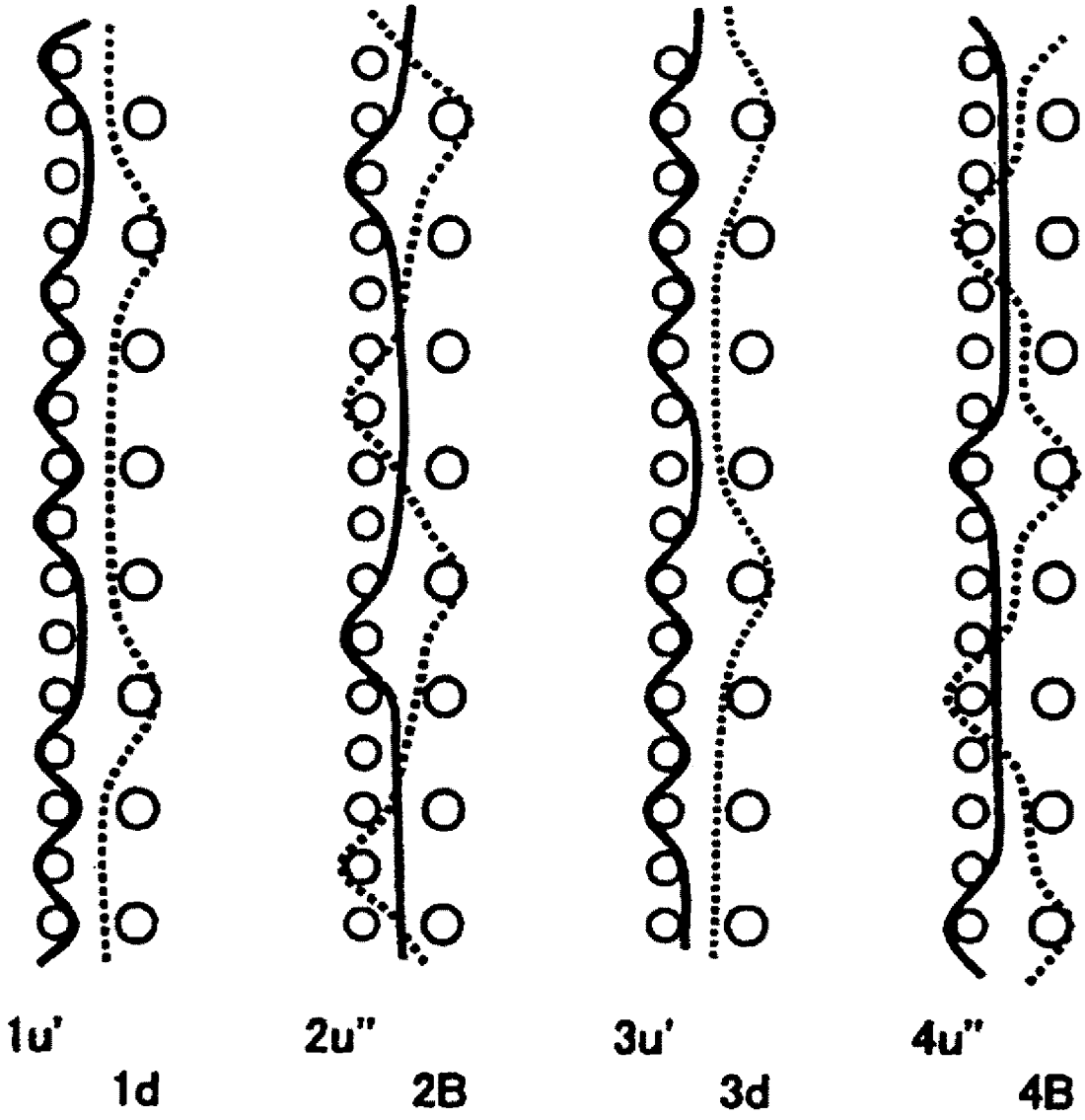
FIG. 14 is a cross sectional view taken along warps 1-4 of the seventh embodiment.
Figure 15:
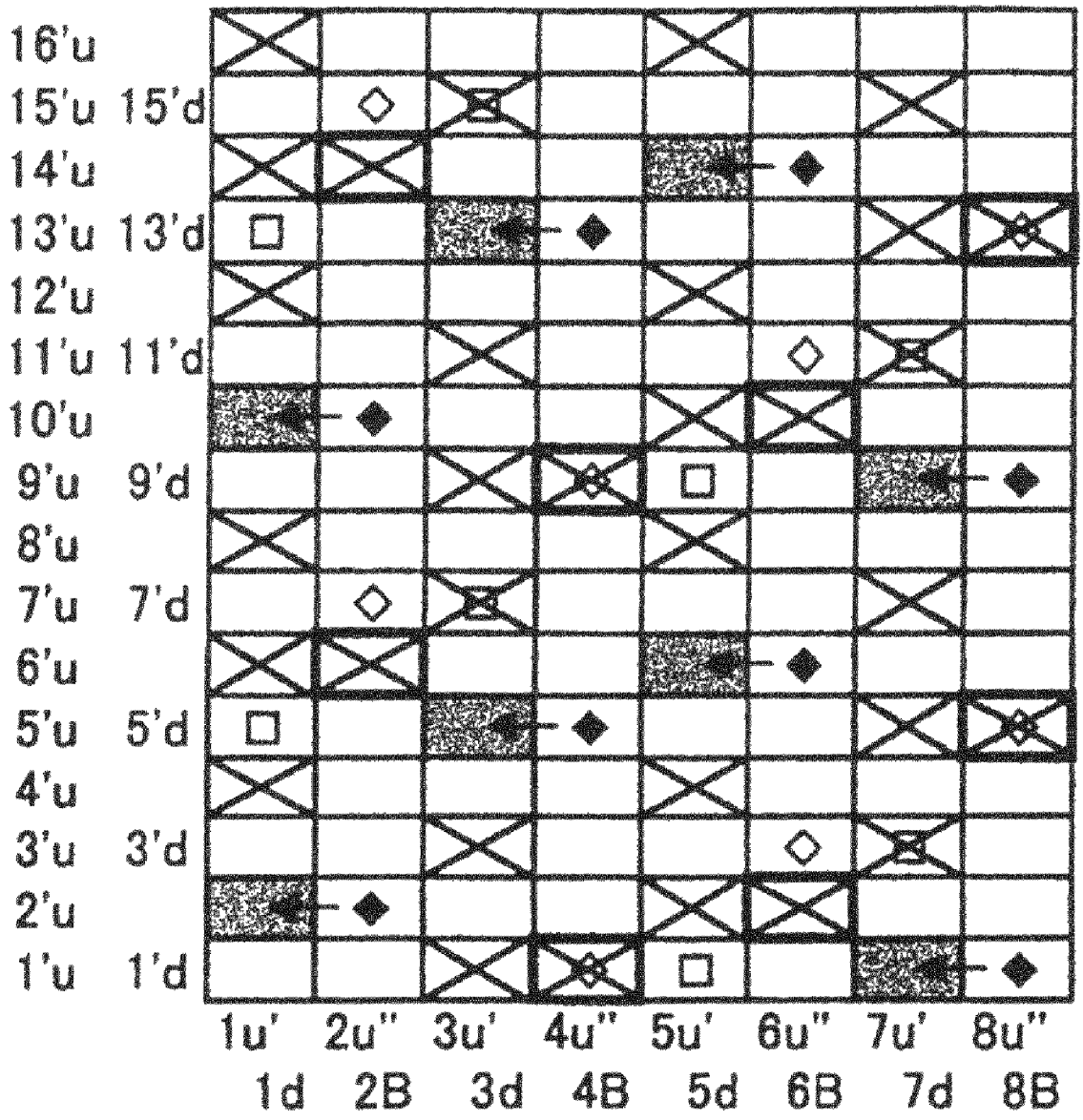
FIG. 15 is a design view showing a complete design of the eighth embodiment according to the present invention.
Figure 16:
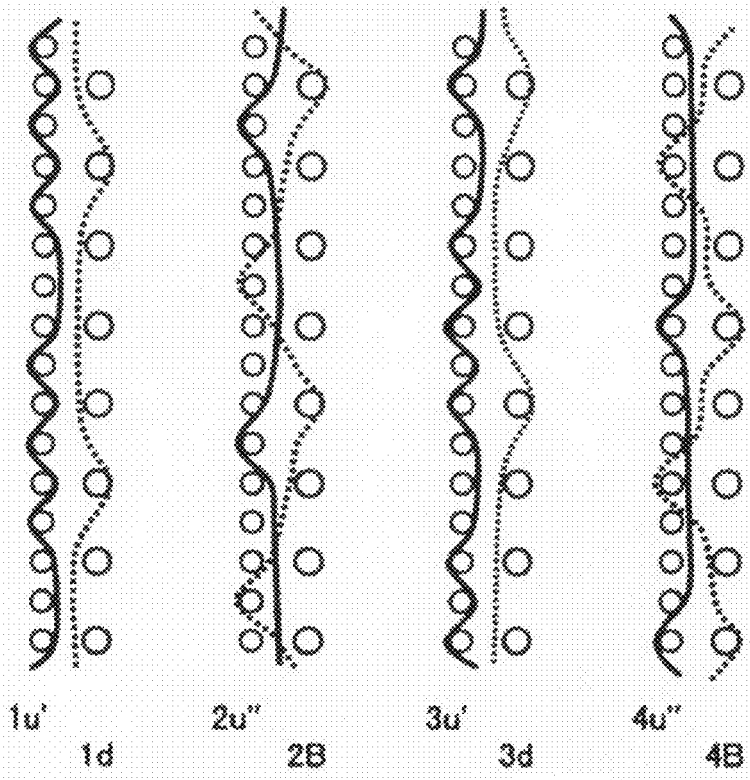
FIG. 16 is a cross sectional view taken along warps 1-4 of the eighth embodiment.
Figure 17:
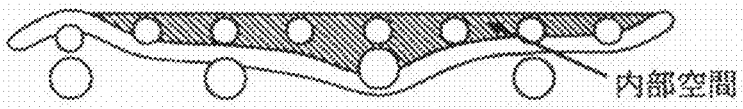
FIG. 17 is a cross sectional view showing an inner space of the fabric along the upper and lower warp binding yarns.
Figure 18:
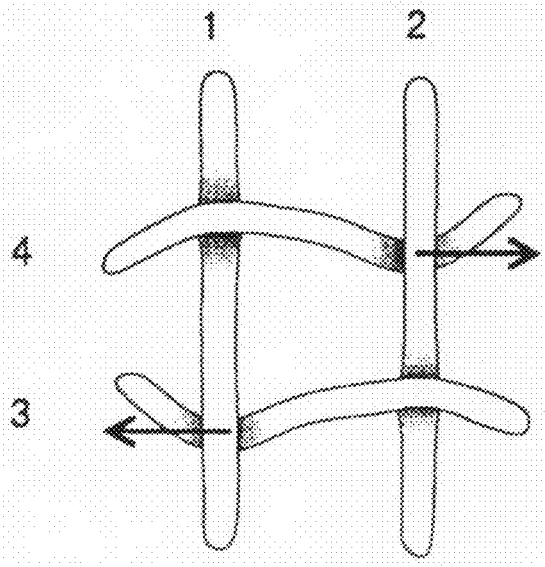
FIG. 18 is a view showing a principle in which a longitudinal groove is formed by aligning knuckles with each other.

1,2,3 . . . 8: pair of upper and lower warps, pair of warp binding yarns

1*u*, 2*u* . . . : upper surface side warp

1*d*, 2*d* . . . : lower surface side warp

1*b*, 1B . . . : warp binding yarn

1'*u*, 2'*u* . . . : upper surface side wefts

1'*d*, 3'*d* . . . : lower surface side wefts

2*u*", 2*u*" . . . : upper surface side warp cooperating with warp binding yarn to form a pair

1*u*', 2*u*' . . . : incomplete upper surface side warps

What is claimed is:

1. An industrial two-layer fabric constituted by at least one upper surface side warp to be woven with at least one upper surface side weft, at least one lower surface side warp to be woven with at least one lower surface side weft, and at least one warp binding yarn to be woven with the at least one upper surface side weft and the at least one lower surface side weft comprising at least one pair of upper and lower warps in which said upper and lower surface side warps are located to be upper and lower, respectively, and at least one pair of warp binding yarns in which at least one yarn constitutes the warp binding yarn, characterized in that all knuckles emerging on the upper surface side formed by the yarns of said pair of warp binding yarns are aligned with knuckles on the upper surface side formed by the upper surface side warp adjacent to said pair of warp binding warps to form a hydrating groove.

2. An industrial two-layer fabric constituted by at least one upper surface side warp to be woven with at least one upper surface side weft, at least one lower surface side warp to be woven with at least one lower surface side weft, and at least one warp binding yarn to be woven with the at least one upper surface side weft and the at least one lower surface side weft comprising at least one pair of upper and lower warps in which said upper and lower surface side warps are located to be upper and lower, respectively, and at least one pair of warp binding yarns in which at least one yarn constitutes the warp binding yarn, characterized in that all or a portion of said upper surface side warps constituting said pair of upper and lower warps constitutes incomplete upper surface side warps in which a portion of knuckles are absent on the upper surface side, said pair of warp binding yarns are arranged so as to be adjacent to said incomplete upper surface side warps, a portion of knuckles emerging on the upper surface side formed by the yarns of said pair of warp binding yarns complements a portion where said knuckles of said incomplete upper surface side warps are absent, other knuckles emerging on the upper surface side are aligned with knuckles on the upper surface side formed by the upper surface side warp adjacent to said pair of warp binding warps to form a hydrating groove.

3. The industrial two-layer fabric according to claim 2, wherein said incomplete upper surface side warps define a design in which two knuckles are absent in a complete design of the fabric.

4. The industrial two-layer fabric according to claim 2, wherein a portion of said knuckles on the upper surface side of the yarns of said pair of warp binding yarns are aligned with the knuckles of the upper surface side warp adjacent thereto, said other knuckles emerging on the upper surface side complement a portion where knuckles are absent on said incomplete upper surface side warp adjacent thereto.

5. The industrial two-layer fabric according to claim 2, wherein one yarn of said pair of warp binding yarns forms knuckles aligned with the knuckles on the upper surface side warp adjacent thereto, the other yarn complements the portion where the knuckles are absent on the incomplete upper surface side warp.

6. The industrial two-layer fabric according to claim 1, wherein each of the yarns of said pair of warp binding yarns is aligned with the knuckles of said upper surface side warp, or complements the knuckles of said upper surface side warp.

7. The industrial two-layer fabric according to claim 1, wherein said pair of warp binding yarns comprises two warp binding yarns, or one warp binding yarn and one upper surface side warp, or one warp binding yarn and one lower surface side warp.

8. The industrial two-layer fabric according to claim 1 comprises a complete design in which said warp binding yarn passes over one or two upper surface side wefts once or twice, and then goes down to the lower layer to pass under one or two lower surface side wefts.

9. The industrial two-layer fabric according to claim 1, wherein said pair of upper and lower warps and said pair of warp binding yarns are arranged in an alternate manner.

* * * * *